US005562487A

United States Patent [19]

Ii et al.

[11] Patent Number: 5,562,487

[45] Date of Patent: Oct. 8, 1996

[54] ELECTRIC CONNECTOR

[75] Inventors: Hidehiro Ii, Koube; Yoshiyuki Mizuno, Sagamihara, both of Japan

[73] Assignee: Molex Incorporated, Lisle, Ill.

[21] Appl. No.: 349,870

[22] Filed: Dec. 6, 1994

[30] Foreign Application Priority Data

Feb. 9, 1994 [JP] Japan ..... 6-036465

[51] Int. Cl.[6] ..... H01R 9/07

[52] U.S. Cl. ..... 439/495

[58] Field of Search ..... 439/495, 496, 439/266, 267

[56] References Cited

U.S. PATENT DOCUMENTS

| | | | |
|---|---|---|---|
| 4,519,133 | 5/1985 | Pansanel | 29/863 |
| 4,695,108 | 9/1987 | Ichitsubo | 439/59 |
| 4,734,053 | 3/1988 | Imai | 439/329 |
| 4,969,840 | 11/1990 | Ii et al. | 439/495 |
| 5,074,797 | 12/1991 | Yamada | 439/62 |
| 5,106,311 | 4/1992 | Yodogawa et al. | 439/77 |
| 5,194,017 | 3/1993 | Consoli | 439/492 |
| 5,240,430 | 8/1993 | Soes | 439/260 |
| 5,308,262 | 5/1994 | Chishima | 439/495 |
| 5,393,250 | 2/1995 | Richardson et al. | 439/825 |
| 5,401,186 | 3/1995 | Nozaki et al. | 439/495 |

FOREIGN PATENT DOCUMENTS

| | | |
|---|---|---|
| 0087710 | 8/1986 | European Pat. Off. . |
| 3929929 | 11/1990 | Germany . |
| 2-86080 | 3/1990 | Japan . |
| 2272585 | 5/1994 | United Kingdom . |
| 2272583 | 5/1994 | United Kingdom . |

*Primary Examiner*—Neil Abrams
*Assistant Examiner*—Yong Kim
*Attorney, Agent, or Firm*—Stephen Z. Weiss

[57] ABSTRACT

Disclosed is an improved electric connector which permits the reduced friction insertion of conductors of a flat flexible cable in a connector housing by a single push, assuring little or no damage to the conductors. The connector includes a housing 1 having terminals 3 arranged laterally and an associated actuator 10 slidably inserted in the connector housing 1. The actuator 10 has a flat stem surface 12 upon which a flat, flexible multiple-conductor cable 16 may lie upon, and a front wall 20 integrally connected to the forward end of the stem 11. The flexible contact arm 6 has an extended section 25 and a non-extended section 26 acting as a cam surface. The top 23 of the front wall of the actuator 10 acts as a cam forward as the actuator is inserted in the housing 1. When the cam follower 23 slides off the extended section 25 onto the non extended section the load on the flexible arm 6 is released allowing the contact point 7 on the arm 6 to be forced into electrical contact with a conductor 19 in the cable 16. While the actuator is being inserted and withdrawn from the housing the cable 16 travels along.

6 Claims, 7 Drawing Sheets

ELECTRIC CONNECTOR

FIELD OF THE INVENTION

The present invention relates to an electric connector, and more particularly to an improved electric connector which is appropriate for use in connecting flat, flexible circuit member like multiple-conductor cables or printed boards to a second circuit member.

SUMMARY OF THE INVENTION

As is well known, to connect flat, flexible multiple-conductor cables or printed boards, use in made of an electric connector comprising a connector housing having a plurality of terminals and an actuator detachably fitted in the housing. Each terminal has a contact arm, which is responsive to insertion of the actuator along with a multiple-conductor cable in the final mounting position for yieldingly bending to cause a resilient, repulsive force to be applied to the contact of the contact arm, thus pushing it against a selected conductor of the multiple-conductor cable at a predetermined pressure. One example of such electric connector is commonly called a zero insertion force "ZIF" type, in which a space is left between the actuator and the contact of the terminal contact arm to permit insertion of a flat, flexible cable without a counter force applied to the flat, flexible cable. When the actuator is fully inserted in the housing in the final mounting position, the contact arm is yieldingly bent to force the contact point of the contact arm against a selected conductor of the flat, flexible cable at a predetermined pressure. Another example of such electric connector is commonly called a non-zero insertion force "NON-ZIF" type, in which a flat, flexible cable is inserted by force until it is inserted into its final mounting position. The inserted cable causes the resilient contact arm to yieldingly bend, thereby permitting the resilient contact arm to contact a selected conductor at a predetermined pressure.

The former "ZIF" type electric connector causes no counter force to the insertion of a flat, flexible cable in the connector, and therefore, there is no fear of damaging the flat, flexible cable. However, it requires two consecutive actions. One action is the insertion of the cable into the housing space and the other action is the movement of the actuator to the final mounting position. Likewise, the withdrawal of the cable requires two consecutive actions. One action to release the actuator and the other to remove the cable.

In contrast, the latter "NON-ZIF" type electric connector requires only one pushing action for insertion and one pulling action for withdrawal of the actuator into the connector housing. However, a relatively strong force is required to insert the actuator and cable into the connector housing. In this "NON-ZIF" situation the conductor will be rubbed by the contact point of the contact arm during the entire insertion and withdrawal action. The conductor is often damaged due to the contact point rubbing on the conductor. In brief, the "NON-ZIF" type electric connector does not have the advantage of a friction-free insertion that the "ZIF" type electric connector has and the "ZIF" type electric connector does not have the advantage of a single push-insertion/single pull-withdrawal that the "NON-ZIF" type electric connector has.

One object of the present invention is to provide an electric connector which permits friction-free insertion of the actuator and cable with a single push-insertion and single pull-withdrawal of the actuator and cable into and out of the connector housing which will prevent the contact point of the terminal from damaging the flat, flexible cable conductor and permitting quick electric connection.

To obtain the object according to the present invention, a new low insertion force electrical connector adapted to connect the conductor of a flat flexible circuit member to a second circuit member is provided. The connector includes a housing with a forward conductor receiving opening and a bottom wall. At least one terminal is mounted in the housing with a base connected to a second circuit member and a flexible arm. The bottom wall and the flexible arm defines a mating region therebetween communicating with the conductor receiving opening. The flexible arm is adapted to be placed in either a preloaded or non-preloaded position. The contact point is adapted to be positioned out of electrical contact with the conductor in the preloaded position, allowing the conductor to be inserted in said mating region. The contact point is adapted to electrically mate with the conductor in the non-preloaded position after the conductor is received within the mating region. The actuator is slidingly received within said mating region between the bottom wall and the flexible arm and having a front portion. The terminal flexible arm has a cam surface. The top of the actuator front portion acts as a cam follower adapted to initially contact an extended section of the cam surface and force the contact point away from the conductor in the preloaded position. As the actuator is further inserted into the housing, the top of the actuator front portion slides beyond the extended section onto a reduced section of the cam surface in the non-preloaded position allowing the flexible arm to force the contact point toward the conductor, establishing an electrical connection therebetween.

In accordance with a second embodiment of the invention, an electrical connector is provided as above with the non-extended section of the cam surface being adjacent the extended section of the cam surface with a gradual transition section extending longitudinally therebetween. In accordance with a third embodiment of the invention, the electrical connector is provided as above with an extended section of the cam surface being followed first, by a non extended section, next, by another extended section and finally by another non-extended section with a curved transition section extending between each of the extended and non-extended sections. In a final embodiment of the invention the actuator has a flat surface upon which the flat flexible cable can lie with an inclined surface of increasing depth as the inclined surface approaches the front portion of the actuator.

BRIEF DESCRIPTION OF THE DRAWINGS

Other objects and advantages of the present invention will be understood from the following description of electric connectors according to the present invention, which are shown in accompanying drawings.

DETAILED DESCRIPTION OF THE PREFERRED EMBODIMENT

Figure 1:
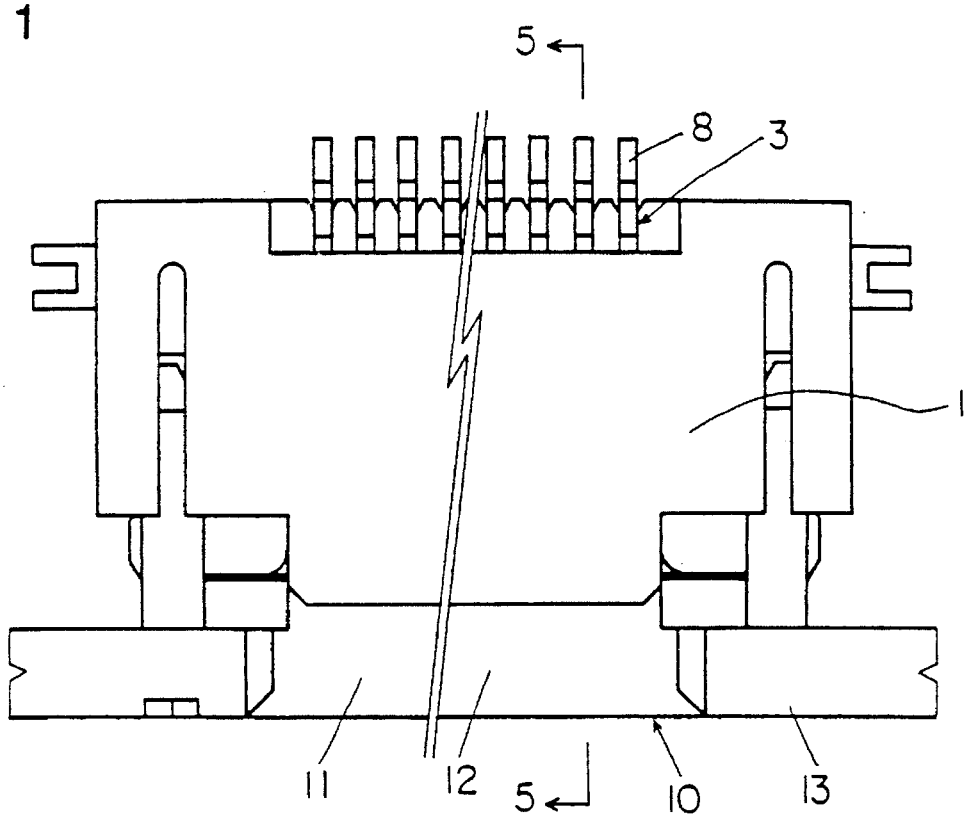
FIG. 1 is a plane view of an electric connector according to a first embodiment of the present invention.

Referring to the drawings, an electric connector has a connector housing 1 with a forward conductor receiving opening 40 and a bottom wall 41. It has a plurality of terminals 3 laterally arranged at regular intervals in its space. Each terminal 3 is composed of a bight 4, a mounting base 5 integrally connected to the lower end of the bight 4, and a flexible contact arm 6 integrally connected to the upper end of the bight 4. The contact arm 6 has a contact point 7 on its free end, and the bight 4 has a solder tail 8 on its lower end extending in a direction opposite to the mounting base 5 and adapted to be soldered to a second circuit member (not shown). The flexible contact arm 6 and housing bottom wall 41 defining a mating region 42 therebetween communicating with the conductor receiving opening 40.

Figure 2:
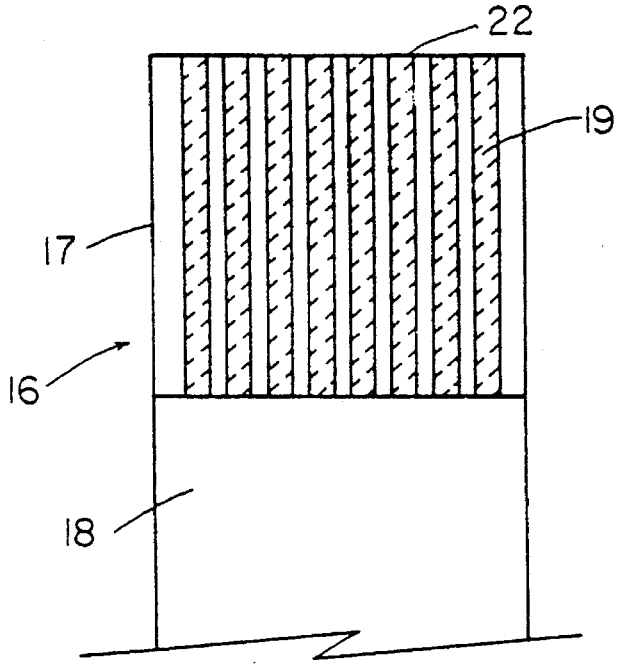
FIG. 2 is a plane view of a flat, flexible multi-conductor cable.
Figure 3:
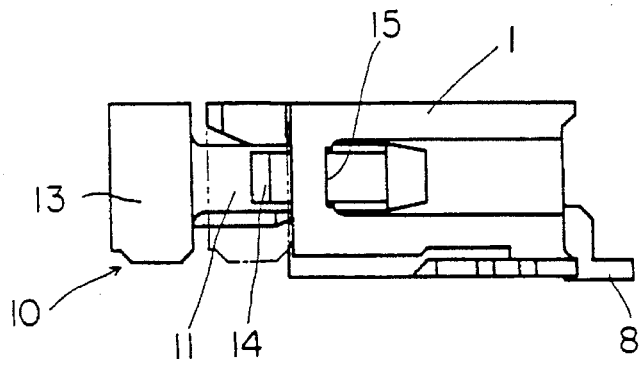
FIG. 3 is a right side view of the electric connector.
Figure 4:
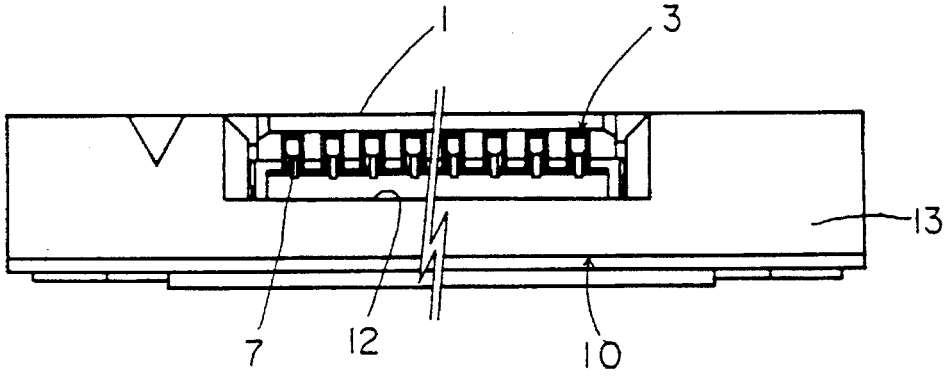
FIG. 4 is a front view of the electric connector.
Figure 5:
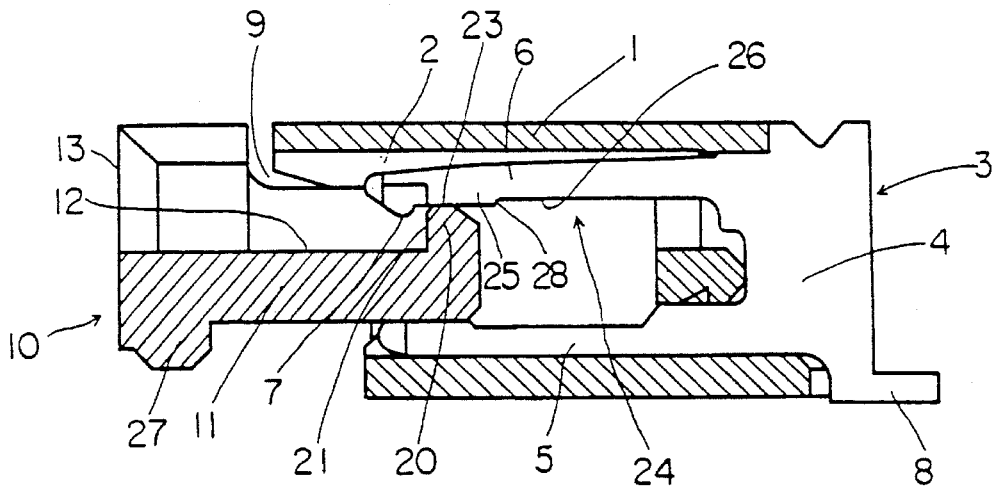
FIG. 5 is a sectional view taken along the line 5—5 in FIG. 2.

An actuator 10 can be detachably and slidably fit into the connector housing 1 within the mating region 42. The actuator 10 is composed of a stem 11, a thumbpiece 13 integrally connected to the rear of the stem 11, and opposite lock-projections 14 integrally connected to the opposite sides of the stem 11. The stem 11 has a flat upper surface 12 upon which a flat, flexible multi-conductor cable may be placed. The opposite lock-projections 14 are adapted to be caught by the counter holes 15 of the connector housing 1. A flat, flexible multi-conductor cable may be an FFC or FPC, or may be a printed board. A flat, flexible multiple-conductor cable is described herein as being used in the electric connector according to the present invention. As shown in FIG. 2, this cable has a plurality of conductors 19 sandwiched between upper and lower flexible insulation strips 17 and 18, and one flexible insulation strip 18 is removed to expose the ends of the conductors 19 at regular intervals.

The stem 11 of the actuator 10 has a rising front wall portion 20 at its forward end. The front portion 20 functions as a stop 21 relative to the leading end 22 of the flat, flexible multi-conductor cable to stop the cable from further insertion after sliding on the upper, flat surface 12 of the stem 11. The top 23 of the front portion 20 faces the lower side 24 of the flexible contact arm 6. The top 23 acts as a cam follower while the lower side 24 acts as a cam surface. As seen from drawings, the stop 21 of the rising front portion 20 is perpendicular to the upper, flat surface 12 of the stem 11.

The flexible contact arm 6 of the terminal 3 has extended section 25 and a non-extended section 26 comprising the lower side cam surface 24. The extended section 25 is arranged longitudinally on the lower side 24 of the flexible contact arm 6 between the contact point 7 and the non-extended section 26. The transition section 28 is also arranged longitudinally on the lower side 24 between the extended section 25 and the non-extended section 26.

When the actuator 10 is in its initial pre-loaded position, the top 23 of the front wall portion 20 is in contact with the extended section 25 of the flexible contact arm 6. A flat, flexible multiple-conductor cable 16 is laid upon the upper, flat surface 12 of the stem 11 of the actuator with its forward end 22 abutting against the stop surface 21 of the front wall portion 20. The contact point 7 of the flexible arm 6 either does not contact a conductor 19 of the flat cable 16, or merely applies a gentle touch to the conductor 19. This lack of contact or gentle touching is a result of the length of the top 23 of the front wall portion 20 and the extended section 25 causing the flexible arm 6 to move far enough so that the distance between the contact point 7 and the flat surface 12 of the actuator 10 is greater than or equal to the thickness of the cable 16.

When the actuator 10 is pushed forward into the final non-preloaded mounting position with the cable 16 laying upon the flat surface 12 of the actuator, the top 23 of the front wall portion 20 will slide off of the extended section 25 of the flexible arm 6, beyond the transition section 28 and slide onto the non-extended section 26. With the actuator 10 and cable 16 in the inserted non-preloaded position, the distance between the contact point 7 and the flat surface 12 of the actuator 10 is less than the thickness of the cable 16. This allows the flexible arm 6 to move toward the cable 16 and causes the contact point 7 to be forced into contact with a selected conductor 19 of the flat cable 16.

In this final non-preloaded mounting position, the stopper 27 of the actuator 10 abuts against the front side of the connector housing 1, while the lock-projections 14 of the actuator 10 are caught by the counter holes 15 of the connector housing. The insertion to the final non-preloaded mounting position is effected only with a single push.

The friction-free insertion of the flat, flexible cable just prior to its arrival at the final non-preloaded mounting position assures that the exposed conductors 19 of a flat, flexible cable are not rubbed by the contact points 7 of the flexible contact arms 6, for a long distance, thus reducing the damage to the conductors and reducing the insertion force.

Figure 8:
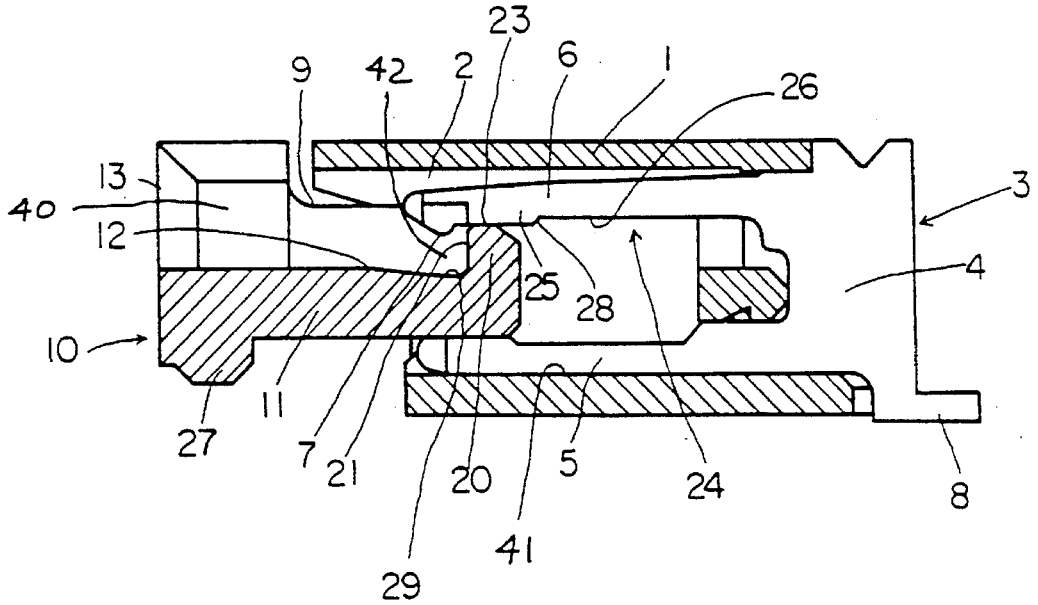
FIG. 8 is similar to FIG. 5, but showing an electric connector according to a second embodiment.
Figure 6:
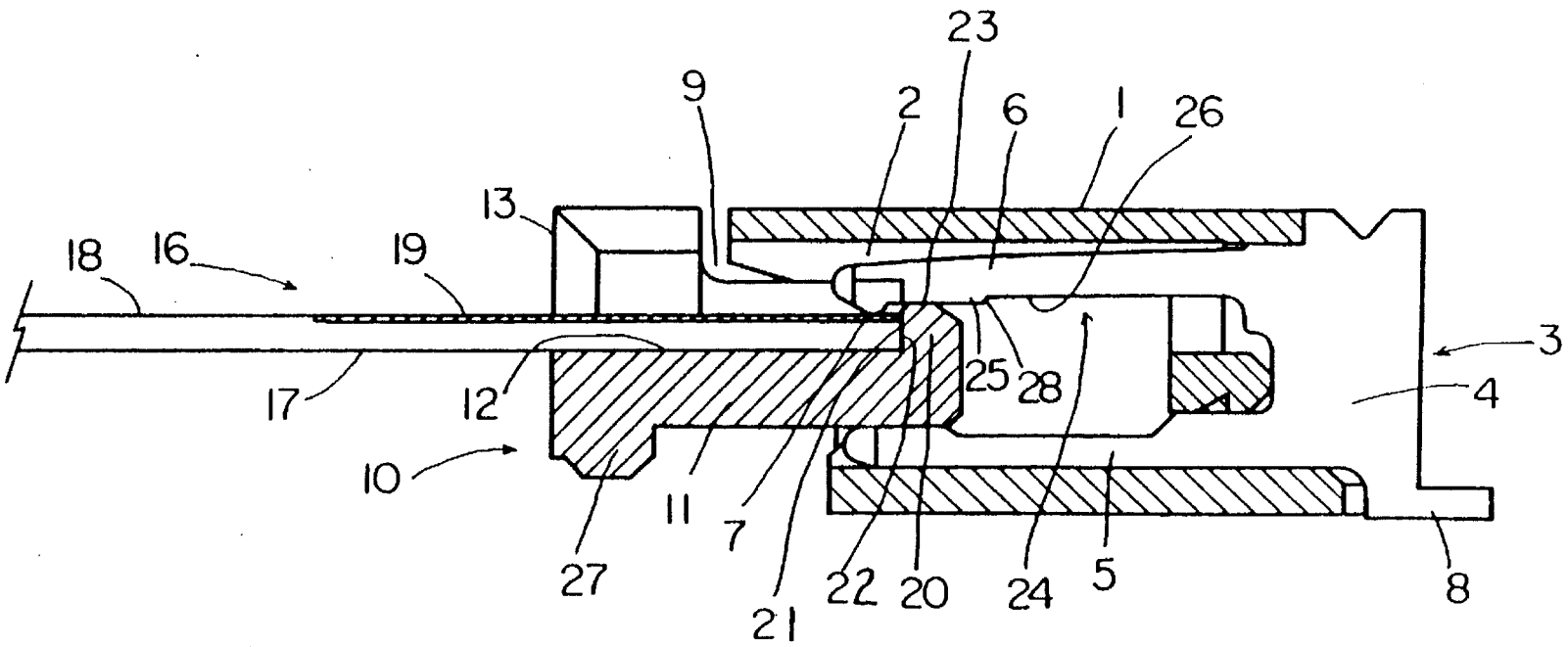
FIG. 6 is a longitudinal section of the electric connector with its actuator put in the initial position.
Figure 7:
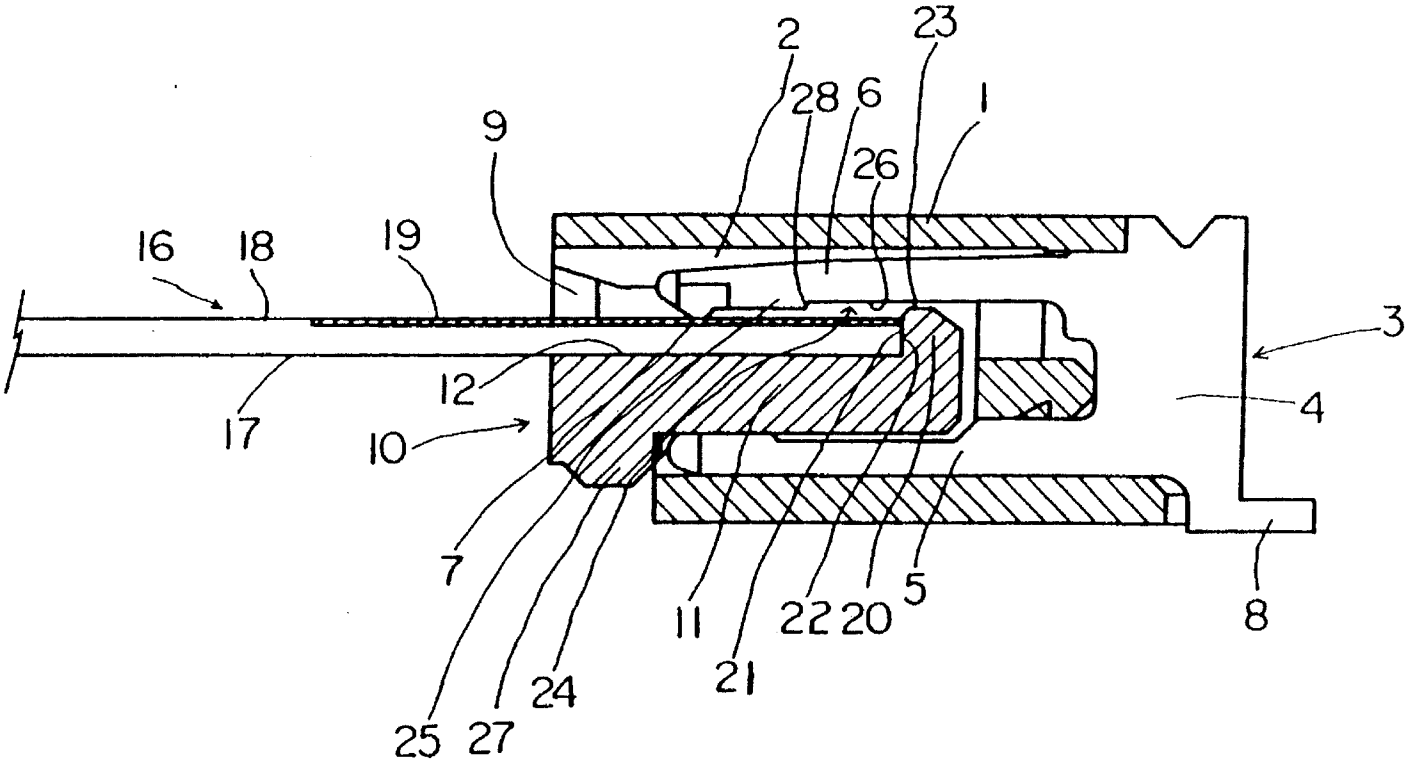
FIG. 7 is a longitudinal section of the electric connector with its actuator put in the final position.

Referring to FIG. 8, an electric connector according to the second embodiment of the present invention uses an actuator having a flat surface 12 and an inclined surface 29. This combined flat-and-inclined surface 12, 29 facilitates insertion of a flat, flexible cable 16 into the connector housing in the initial pre-loaded position.

Figure 9:
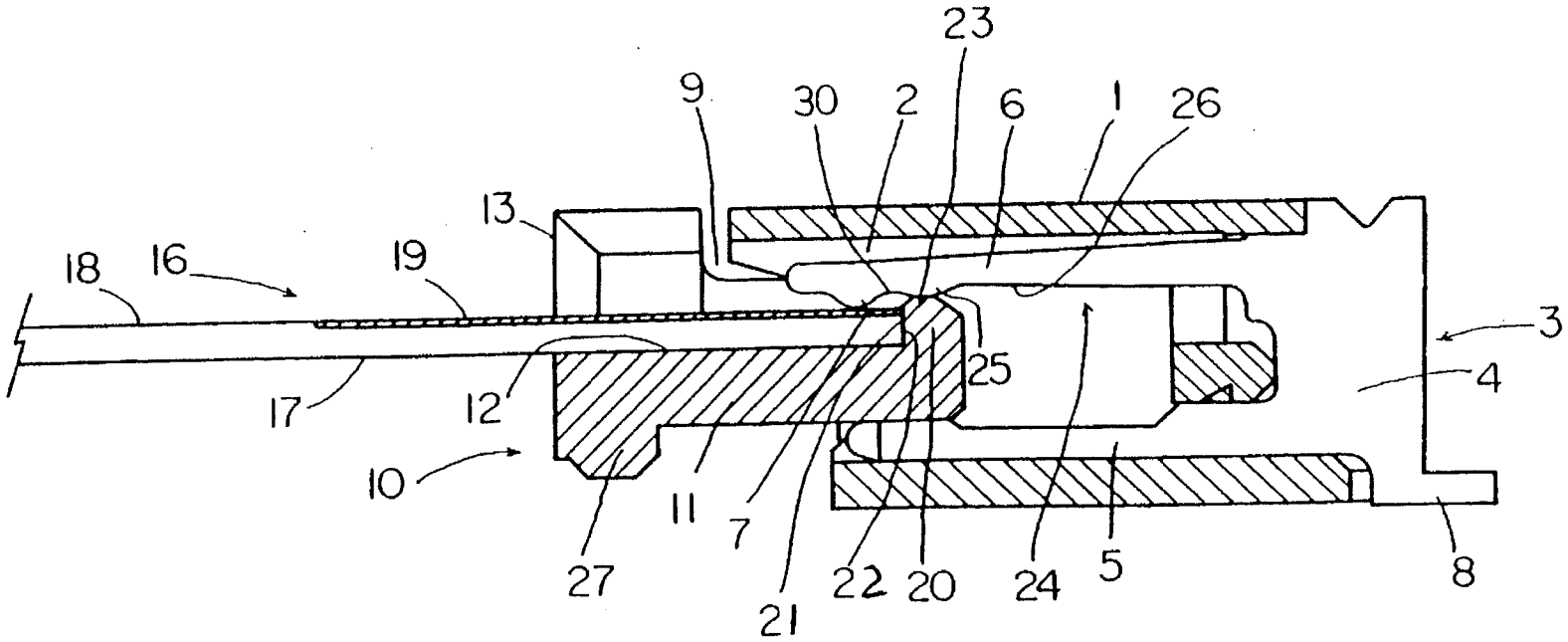
FIG. 9 is a longitudinal section of an electric connector according to a third embodiment with its actuator put in the initial position.
Figure 10:
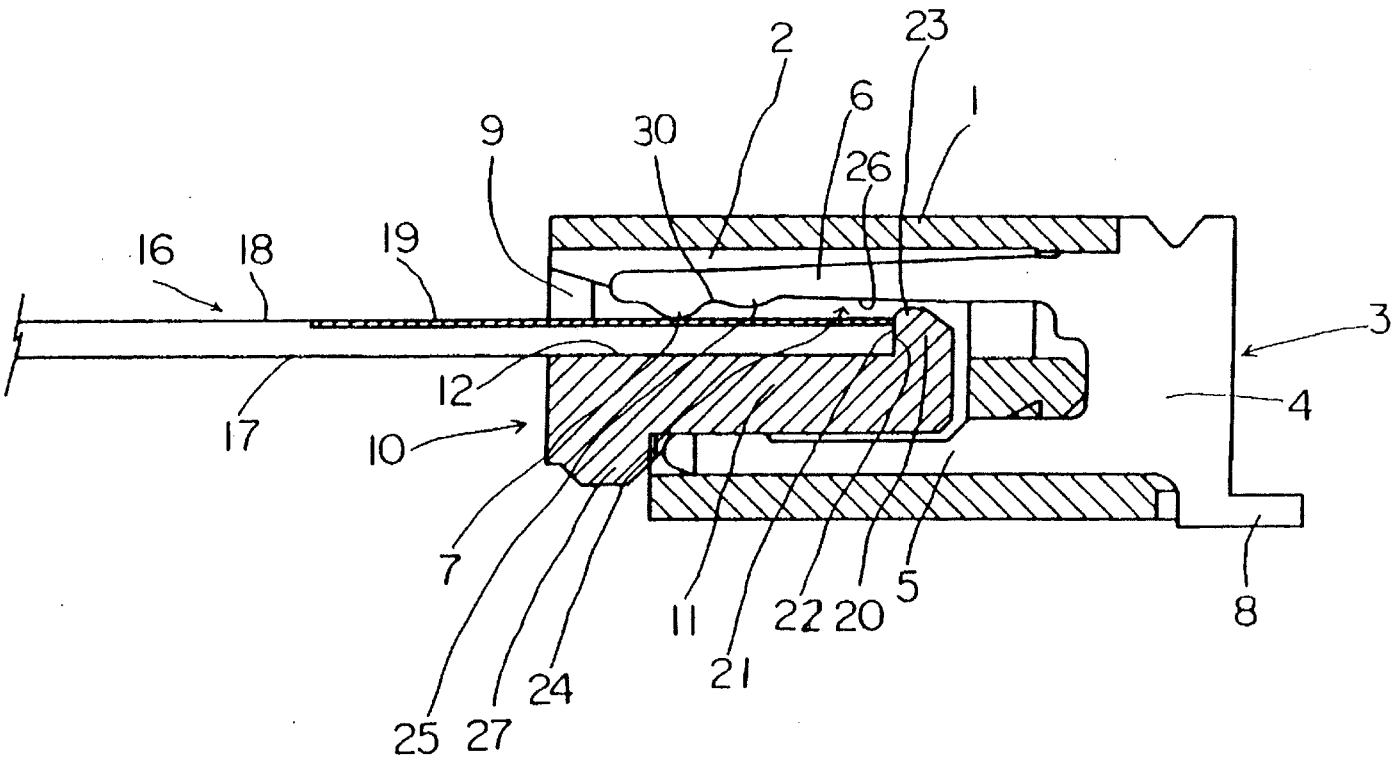
FIG. 10 is a longitudinal section of the electric connector with its actuator put in the final position.

Referring to FIG. 9 and 10, an electric connector according to the third embodiment of the present invention uses a flexible contact arm 6 in which an extended section 25 is formed adjacent the contact point 7 with an intervening non-extended section 30 therebetween, and another non-extended section 26 on the other side of the extended section 25. The remote positioning of the extended section 25 reduces the distance over which the conductor is subjected to rubbing by the contact point 7. This will reduce damage to the conductor 19 and reduce the insertion force more than would be reduced with the first embodiment disclosed herein.

As may be apparent, from the above, an electric connector according to the present invention permits the reduced friction insertion of conductors into the connector housing with a single push, reducing the damage to the conductors.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. A low insertion force electrical connector adapted to connect a conductor of a first flat flexible circuit member having at least one conductor to another circuit member, said connector including, a housing with a forward conductor receiving opening and a bottom wall, a terminal mounted in the housing with a base connected to said another circuit member and a flexible arm, wherein said bottom wall and said flexible arm defining a mating region therebetween communicating with said conductor receiving opening, said flexible arm, adapted to be placed in either a preloaded or non-preloaded position, having a contact point on a side of said flexible arm adapted to be positioned out of electrical contact with said conductor in said preloaded position, allowing said conductor to be inserted in said mating region, and said contact point adapted to electrically mate with said conductor in said non-preloaded position after said cable with said conductor is received within the mating region, an actuator slidingly received within said mating region between said bottom wall and said flexible arm and having a front portion, the improvement comprising:

said terminal flexible arm having a cam surface separate from said contact point and on the same side of the flexible arm as the contact point, and said actuator front portion having a cam follower adapted to contact an extended section of said cam surface and force said contact point away from said conductor in said preloaded position and, as the actuator is further inserted into the mating region, said cam follower sliding off said extended section onto a non-extended section of said cam surface in said non-preloaded position allowing said flexible arm to force said contact point toward the conductor, establishing an electrical connection therebetween.

2. An electrical connector according to claim 1, wherein said non-extended section of the cam surface is adjacent the extended section of the cam surface with a gradual transition section extending longitudinally therebetween.

3. An electrical connector according to claim 1, wherein said contact point is followed first by a non extended section, next by an extended section and finally by another non-extended section with a curved transition section extending between said extended and said non-extended sections.

4. An electrical connector according to claim 1, wherein said actuator has a flat surface upon which said flat flexible cable can lie while said actuator moves from said preloaded to said non-preloaded positions.

5. An electrical connector according to claim 4 wherein said flat surface has an inclined surface with increasing depth as the inclined surface approaches the front portion of the actuator.

6. A low insertion force electrical connector adapted to connect a conductor of a first flat flexible circuit member having at least one conductor to another circuit member, said connector including, a housing with a forward conductor receiving opening and a bottom wall, a terminal mounted in the housing with a base connected to said another circuit member and a flexible arm, wherein said bottom wall and said flexible arm defining a mating region therebetween communicating with said conductor receiving opening, said flexible arm, adapted to be placed in either a preloaded or non-preloaded position, having a contact point adapted to be positioned out of electrical contact with said conductor in said preloaded position, allowing said conductor to be inserted in said mating region, and said contact point adapted to electrically mate with said conductor in said non-preloaded position after said cable with said conductor is received within the mating region, an actuator slidingly received within said mating region between said bottom wall and said flexible arm and having a front portion, the improvement comprising:

said terminal flexible arm having cam surface;

said actuator having a flat surface upon which said flat flexible circuit member can lie while said actuator moves from said preloaded to said non-preloaded positions said flat surface being inclined with increasing depth as the flat surface approaches the front portion of the actuator, and said actuator front portion having a cam follower adapted to contact an extended section of said cam surface and force said contact point away from said conductor in said preloaded position and, as the actuator is further inserted into the mating region, said cam follower sliding off said extended section onto a non-extended section of said cam surface in said non-preloaded position allowing said flexible arm to force said contact point toward the conductor, establishing an electrical connection therebetween.

* * * * *